US008721124B2

(12) United States Patent
Byrne et al.

(10) Patent No.: US 8,721,124 B2
(45) Date of Patent: May 13, 2014

(54) RETRACTABLE LIGHT ASSEMBLY

(76) Inventors: Norman R. Byrne, Ada, MI (US); Robert L. Knapp, Rockford, MI (US); Randell E. Pate, Jenison, MI (US); Timothy J. Warwick, Sparta, MI (US); Peter Stathis, San Francisco, CA (US)

( * ) Notice: Subject to any disclaimer, the term of this patent is extended or adjusted under 35 U.S.C. 154(b) by 0 days.

(21) Appl. No.: 13/494,204

(22) Filed: Jun. 12, 2012

(65) Prior Publication Data

US 2012/0314418 A1 Dec. 13, 2012

Related U.S. Application Data

(60) Provisional application No. 61/496,036, filed on Jun. 12, 2011.

(51) Int. Cl.
*F21V 21/22* (2006.01)

(52) U.S. Cl.
USPC ..... 362/285; 362/419; 362/421; 362/249.1

(58) Field of Classification Search
USPC ..... 362/285–289, 418–430, 188, 190, 191, 362/220, 233, 249.07, 249.1
See application file for complete search history.

(56) References Cited

U.S. PATENT DOCUMENTS

| | | | | |
|---|---|---|---|---|
| 1,476,149 | A | | 12/1923 | Cohen |
| 2,811,574 | A | | 10/1957 | Guerrero |
| 3,433,886 | A | | 3/1969 | Myers |
| 3,622,684 | A | | 11/1971 | Press |
| 3,646,244 | A | | 2/1972 | Cole |
| 3,671,735 | A | | 6/1972 | King |
| 3,794,956 | A | | 2/1974 | Dubreuil |
| 3,944,806 | A | * | 3/1976 | Jones et al. ..... 362/191 |
| 4,180,850 | A | | 12/1979 | Bivens |
| 4,337,506 | A | | 6/1982 | Terada |
| 4,388,678 | A | | 6/1983 | Turner |
| 4,511,198 | A | | 4/1985 | Mitchell et al. |
| 4,541,663 | A | | 9/1985 | Schwanitz et al. |
| 4,551,577 | A | | 11/1985 | Byrne |
| 4,612,604 | A | | 9/1986 | Schlyter |
| 4,747,788 | A | | 5/1988 | Byrne |
| 4,910,650 | A | | 3/1990 | Gorainik |
| 4,974,134 | A | * | 11/1990 | Bourne ..... 362/286 |
| 4,984,139 | A | | 1/1991 | Goggia |
| 4,994,946 | A | | 2/1991 | NakaMats |
| 5,012,394 | A | * | 4/1991 | Woodward ..... 362/198 |
| 5,072,345 | A | | 12/1991 | Goggia |
| 5,075,834 | A | * | 12/1991 | Puglisi ..... 362/386 |
| 5,265,000 | A | * | 11/1993 | Lin ..... 362/413 |
| 5,351,173 | A | | 9/1994 | Byrne |
| 5,513,085 | A | * | 4/1996 | Bourne ..... 362/286 |
| 5,727,875 | A | | 3/1998 | Huang |

(Continued)

*Primary Examiner* — Bao Q Truong
(74) *Attorney, Agent, or Firm* — Gardner, Linn, Burkhart & Flory, LLP

(57) ABSTRACT

A retractable lamp assembly is provided for illuminating at least a portion of a work surface from a wide range of heights and angles by way of extendable shafts and pivot joints. The lamp may be stowed in a retracted or lowered configuration when not in use, in which a substantial portion of the extendable structure is stowed inside of a housing that is located substantially below the work surface, to provide a generally unobtrusive configuration. An upper cover serves as a light reflector when the lamp is in use, and may serve as a cover positioned at or near the work surface when the lamp is stowed. Optionally, the lamp assembly includes include power and data and wire management capabilities for use at the work surface.

22 Claims, 19 Drawing Sheets

(56) References Cited

U.S. PATENT DOCUMENTS

| | | | | |
|---|---|---|---|---|
| 6,099,139 | A * | 8/2000 | Lapensee | 362/153.1 |
| 6,533,431 | B2 | 3/2003 | Leifer et al. | |
| 6,634,763 | B1 | 10/2003 | Leifer et al. | |
| 6,767,107 | B1 | 7/2004 | Leifer et al. | |
| 7,322,735 | B1 * | 1/2008 | Caldani et al. | 362/648 |
| 7,670,032 | B2 | 3/2010 | Lau | |
| 7,810,964 | B2 * | 10/2010 | Probasco | 362/372 |
| 7,931,388 | B2 * | 4/2011 | Kanpurwala et al. | 362/249.03 |
| 8,303,134 | B2 | 11/2012 | Byrne | |
| 8,414,164 | B2 * | 4/2013 | Ogawa et al. | 362/373 |
| 2002/0041499 | A1 | 4/2002 | Pederson | |
| 2005/0201085 | A1 * | 9/2005 | Aikawa et al. | 362/198 |
| 2009/0091930 | A1 * | 4/2009 | Probasco | 362/235 |
| 2010/0317223 | A1 | 12/2010 | Byrne | |
| 2011/0019391 | A1 | 1/2011 | Welter | |
| 2012/0009820 | A1 | 1/2012 | Byrne | |
| 2012/0014097 | A1 | 1/2012 | Byrne | |

* cited by examiner

RETRACTABLE LIGHT ASSEMBLY

CROSS REFERENCE TO RELATED APPLICATION

The present application claims the priority benefit of U.S. provisional application Ser. No. 61/496,036, filed Jun. 12, 2011, which is hereby incorporated herein by reference in its entirety.

FIELD OF THE INVENTION

The present invention relates to light assemblies and, more particularly, to light assemblies which can be mounted to work surfaces such as tables, desks, and the like.

BACKGROUND OF THE INVENTION

Work surface lighting is commonly used for lighting portions of desktops, tabletops, and other work surfaces. Typical work surface lighting includes portable electric lamps with bases that rest directly on the work surface, or lamps that are permanently or semi-permanently bolted or fastened, or releasably clamped, to an edge of a table or desk or the like. Other work surface lighting may include area lighting on the underside of desk hutches or shelving, or spotlighting or floodlighting directed at the work surface from an overhead location such as a ceiling or hanging fixture.

SUMMARY OF THE INVENTION

The present invention provides a retractable light assembly that is mountable at or in a work surface, such as a desk, a table, or the like, and is repositionable between a raised position in which a lamp portion is spaced above the work surface, and a lowered or stowed position in which the lamp portion is positioned at (or at least partially recessed in) the work surface. For example, when the lamp portion is positioned at the work surface, an upper surface or cover of the lamp portion may be substantially flush with the work surface. When in its raised or extended position, the lamp may be oriented and directed in substantially any desired direction in order to direct light from the lamp to a desired portion or region of the work surface. Optionally, the retractable light assembly includes one or more electrical power and/or data outlets or charging ports, which may be accessible when the lamp portion is in its raised position, and which may be substantially hidden when the lamp portion is lowered.

According to one aspect of the invention, a retractable light assembly includes a lower housing, a lamp, and at least one extendable shaft coupled between the lower housing and the lamp. The lower housing is positionable at or in a work surface, such as a desk, a table, or the like. The lamp, by way of its connection to the lower housing, is repositionable between at least a raised position in which it is spaced above the lower housing, and a lowered position at the lower housing. The lamp illuminates at least a portion of the work surface when it is in its raised position. The extendable shaft has a lower end portion that coupled to the lower housing, and an upper end portion coupled to the lamp. A gimbal joint is provided at the lower end portion of the extendable shaft, for coupling the extendable shaft to the lower housing, or at the upper end portion of the extendable shaft for coupling the extendable shaft to the lamp, or at both the upper and lower end portions of the shaft. The lamp is pivotable about the gimbal joint at least when the lamp is in the raised position, so that light emanating from the lamp can be directed to a desired area of the work surface.

Optionally, a first gimbal joint is located at the lower end portion of the extendable shaft for coupling the shaft to the lower housing, and a second gimbal joint is located at the upper end portion of the extendable shaft for coupling the shaft to the lamp, so that the lamp is independently pivotable about the first and second gimbal joints for illuminating a desired portion of the work surface. The lamp may further be rotatable about a longitudinal axis of the extendable shaft. The gimbal joints may be ball joints, for example.

Optionally, the light assembly includes at least two of the extendable shafts, which have respective lower end portions, upper end portions, and first and second gimbal joints.

Optionally, the extendable shaft includes a plurality of telescoping shaft portions that are extendable and retractable relative to one another. Optionally, the extendable shaft is configured to position the lamp at a plurality of the raised positions, between a fully raised position and a fully lowered position.

Optionally, a cover member is positioned atop the lamp, and is configured to reflect light from the lamp in the direction of the work surface. The cover member may substantially cover an upper end portion of the lower housing when the lamp is at a fully lowered position. In addition, the cover member may be substantially flush with an upper surface portion of the work surface when the lamp is at the fully lowered position, with a substantial portion of the lamp received in the lower housing.

Optionally, the light assembly further includes an upper flange at an upper end portion of the lower housing, and a bracket that is movably coupled to an exterior side wall of the housing. The bracket is securable against a lower surface portion of the work surface when the upper flange engages an upper surface portion of the work surface, to thereby secure the lower housing to the work surface. The bracket may be adjustable so that is can engage the lower surface portion of the work surface for a range of thicknesses of the work surface.

Optionally, the light assembly further includes at least one electrical power outlet at an upper end portion of the lower housing. When the lamp includes a cover member, the cover member may be sized and shaped to substantially cover the electrical power outlet or outlets when the lamp is at a fully lowered position.

Optionally, the lamp is an electric lamp, such as an incandescent lamp, a fluorescent lamp, an LED lamp, or the like. The lower housing and the extendable shaft may include electrical wiring in communication with the electric lamp, for energizing the lamp.

According to another aspect of the invention, a retractable light assembly includes a lower housing configured to be positioned at or in a work surface, an electric lamp, and a pair of extendable shafts that couple the lamp to the lower housing. The lamp is repositionable between at least one raised position spaced above the lower housing, and a lowered position in which the lamp is adjacent or located at least partially inside of the lower housing. The lamp is capable of illuminating at least a portion of the work surface when the lamp is in its raised position. The shafts are telescoping shafts that are longitudinally extendable and retractable, and have respective lower end portions pivotably coupled to the lower housing via respective lower pivot joints, and respective upper end portions pivotably coupled to the electric lamp via respective upper pivot joints. The lamp is pivotable about the upper and lower pivot joints when the lamp is in the raised position.

Optionally, the light assembly further includes a substantially vertically movable carriage disposed in the lower housing. The lower pivot joints are coupled to the movable carriage and are movable with the carriage between a raised position (corresponding to the raised position of the lamp) and a lowered position (corresponding to the lowered position of the lamp). The extendable shafts may be positioned substantially inside of the lower housing when the lamp is in a fully-lowered position.

Optionally, a friction element in the lower housing resists movement of the carriage, so that the carriage will remain in a substantially fixed position relative to the lower housing until application of a force sufficient to overcome the friction element.

Thus, the retractable light assembly of the present invention provides a lamp at a work surface, which is positionable to illuminate a desired region of the work surface, and from multiple different angles. The lamp is also capable of being stowed in a retracted or lowered configuration that is relatively unobtrusive, such as substantially flush with the work surface, when the lamp is not in use.

These and other objects, advantages, purposes and features of the present invention will become apparent upon review of the following specification in conjunction with the drawings.

DESCRIPTION OF THE PREFERRED EMBODIMENTS

Figure 1:
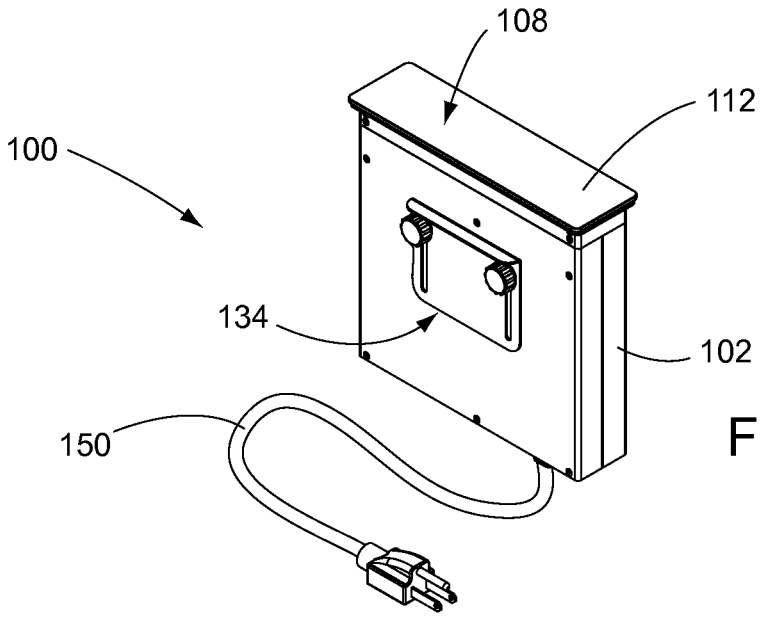
FIG. 1 is a perspective view of a retractable light assembly in accordance with the present invention, shown with an electric lamp portion in a fully retracted position.
Figure 2:
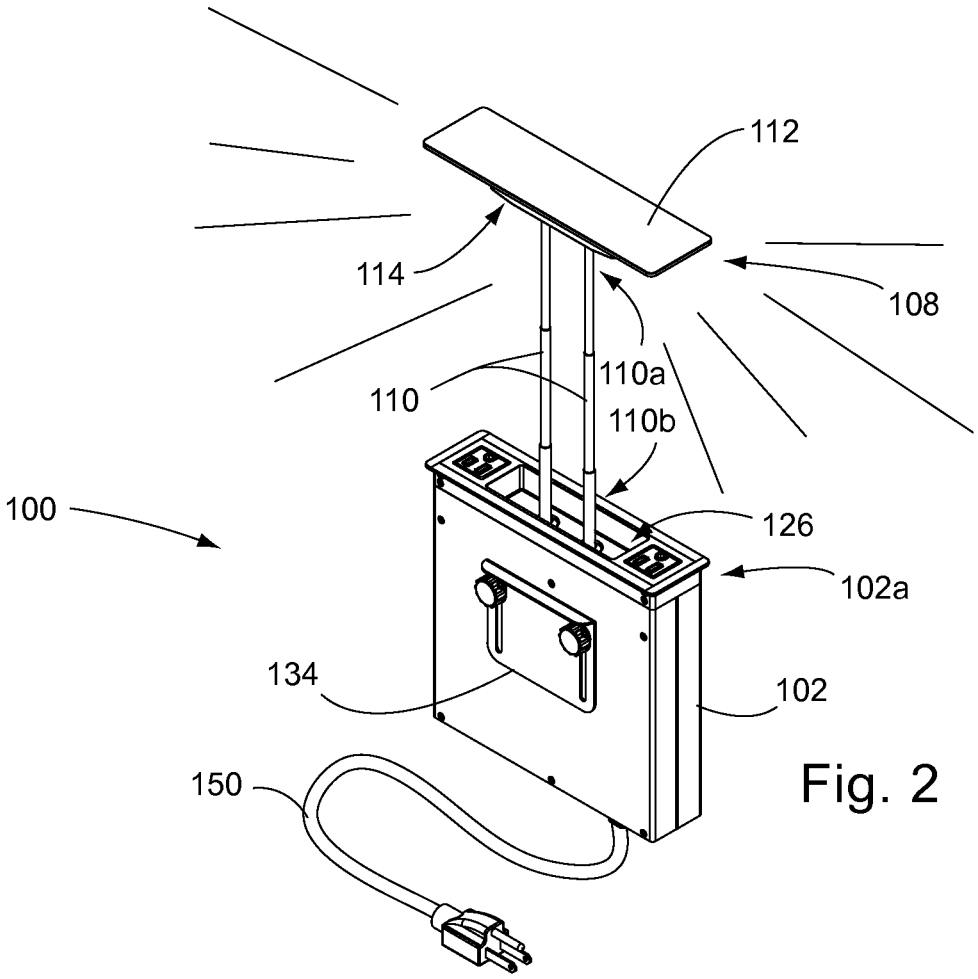
FIG. 2 is another perspective view of the light assembly of FIG. 1, shown with the electric lamp portion partially-extended from the lower housing and illuminated.

Referring now to the drawings and the illustrative embodiments depicted therein, a retractable light assembly 100 (FIGS. 1-6A) is provided for selectively extending and illuminating at least a portion of a work surface to which the light assembly is mounted. Retractable light assembly 100 includes a lower housing 102 that is receivable in an opening 104 formed or established in a work surface 106 (FIGS. 22 and 23) such as a table top, desk top, or the like. Light assembly 100 further includes an extendable or raisable electric lamp assembly 108 including a pair of telescopic extendable shafts 110, a cover/reflector member 112, and an electric lamp unit 114 (FIGS. 2, 5, 6, 6A, and 7). Once lamp assembly 108 is extended to one of a plurality of raised positions, such as shown in FIGS. 2, 5, 6, 6A and 25-32, lamp unit 114 is energized and may be pivoted or rotated or moved to a plurality of different positions and orientations by a user, for illuminating a desired region of the work surface 106, as will be described in more detail below.

Figure 9:
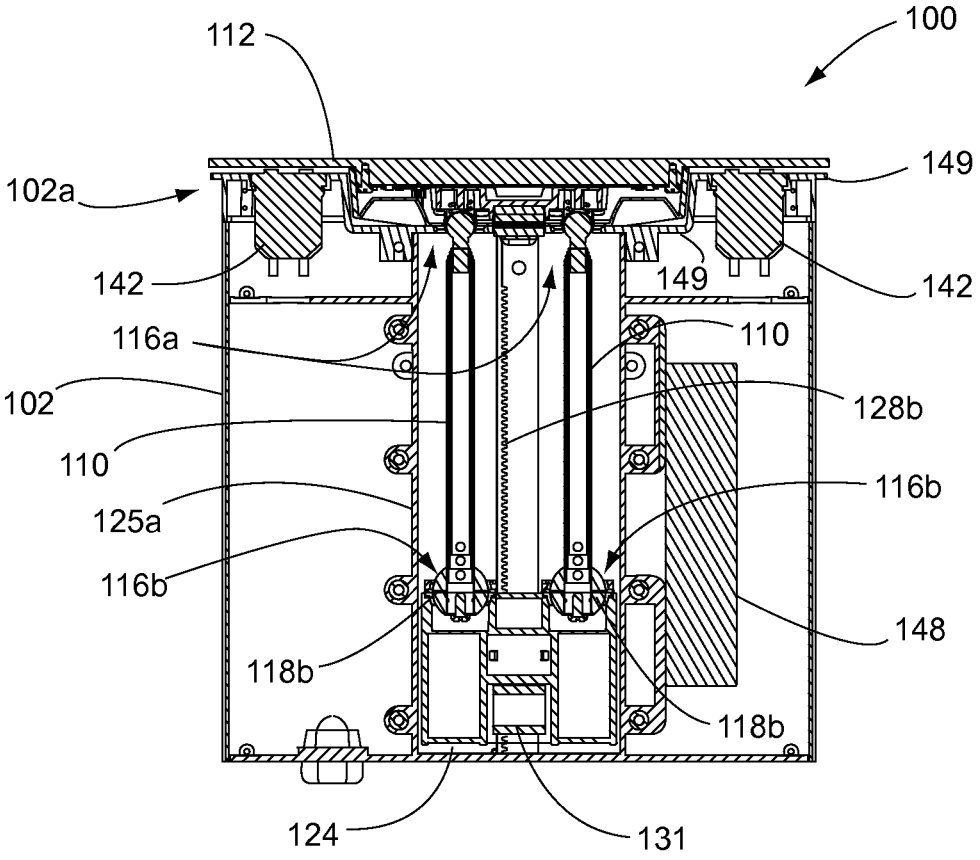
FIG. 9 is a side sectional elevation of the retractable light assembly taken along section line IX-IX of FIG. 8.
Figure 10:
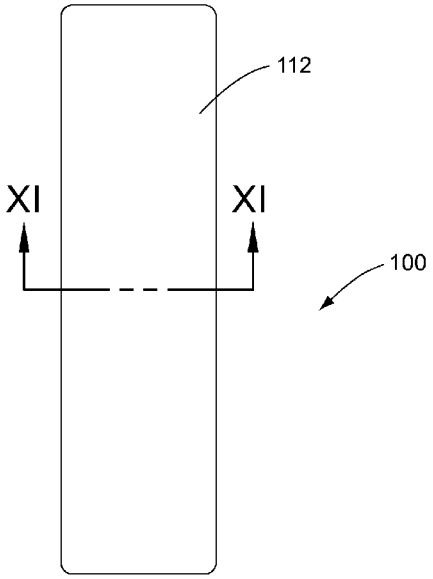
FIG. 10 is another top plan view of the retractable light assembly of FIG. 1, similar to the view of FIG. 8, but with the retractable light assembly rotated by 90°.
Figure 11:
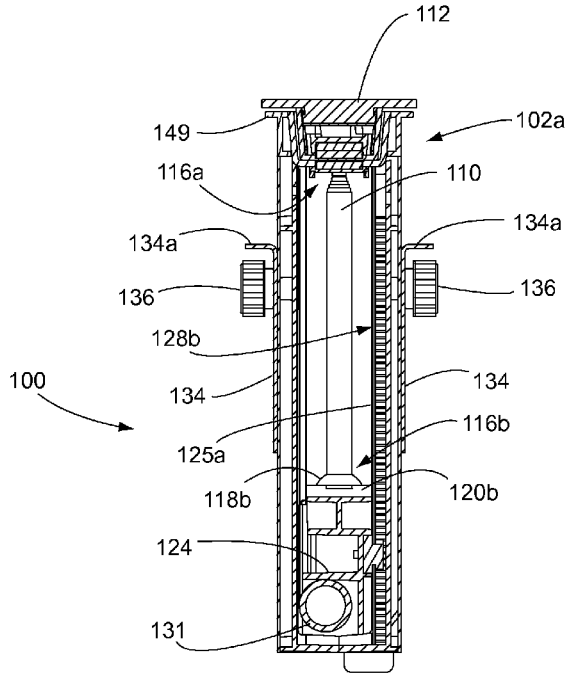
FIG. 11 is an end sectional elevation of the retractable light assembly take along section line XI-XI of FIG. 10, but showing the releasable work surface connectors attached to the lower housing.
Figure 12:
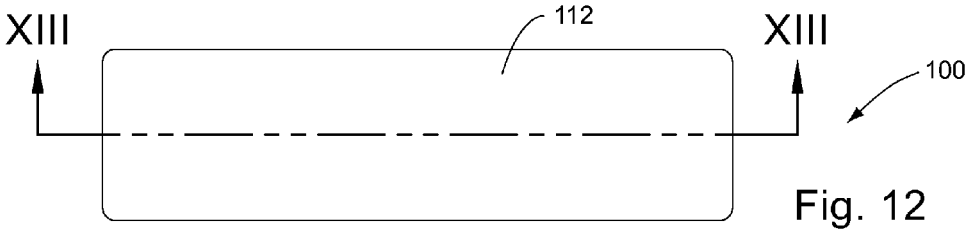
FIG. 12 is a top plan view of the retractable light assembly, similar to the view of FIG. 8, but with the retractable light assembly shown in a partially extended position.
Figure 13:
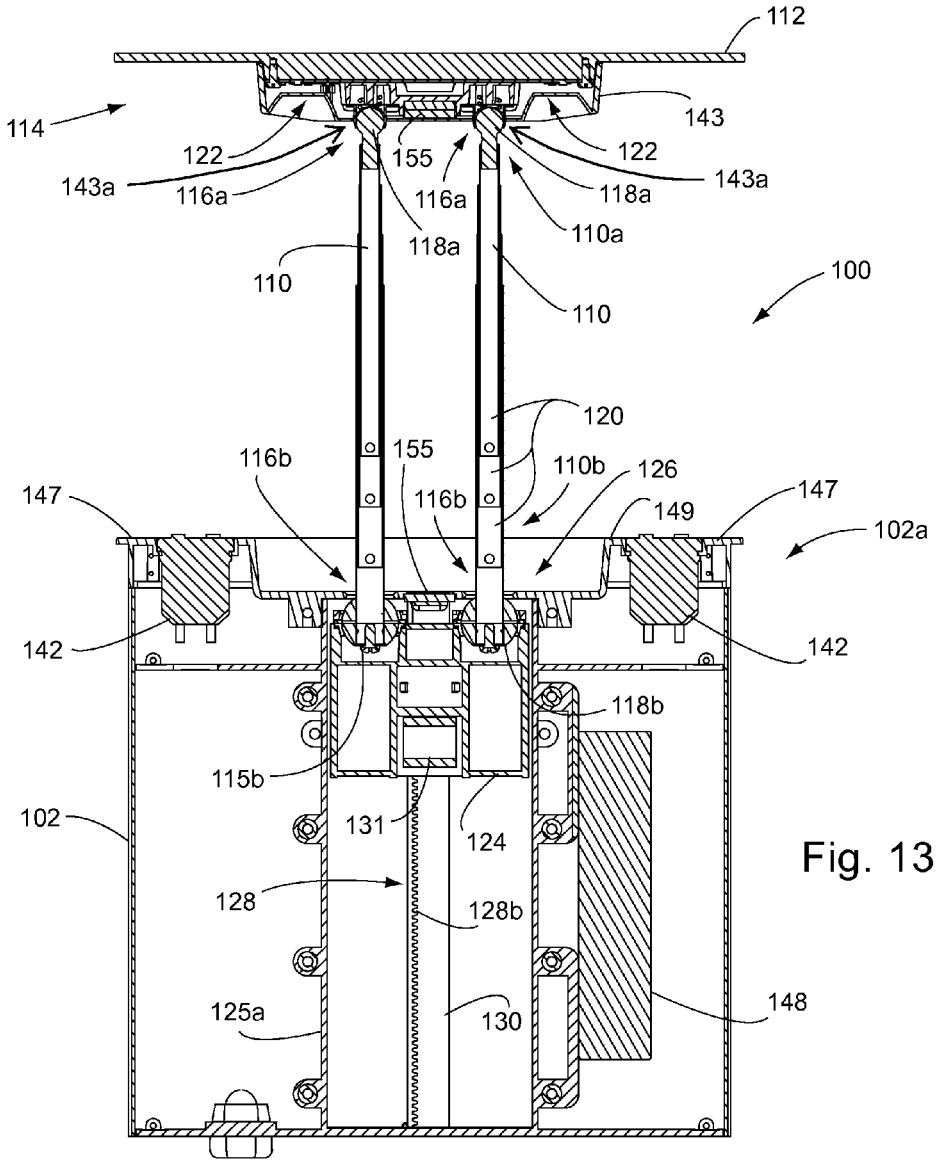
FIG. 13 is a side sectional elevation of the light assembly taken along section lines XIII-XIII of FIG. 12.
Figure 14:
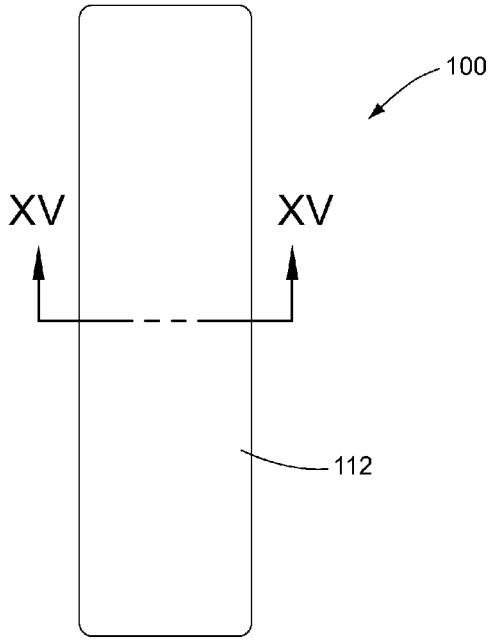
FIG. 14 is a top plan view of the retractable light assembly, similar to the view of FIG. 12, but with the retractable light assembly rotated by 90°.
Figure 15:
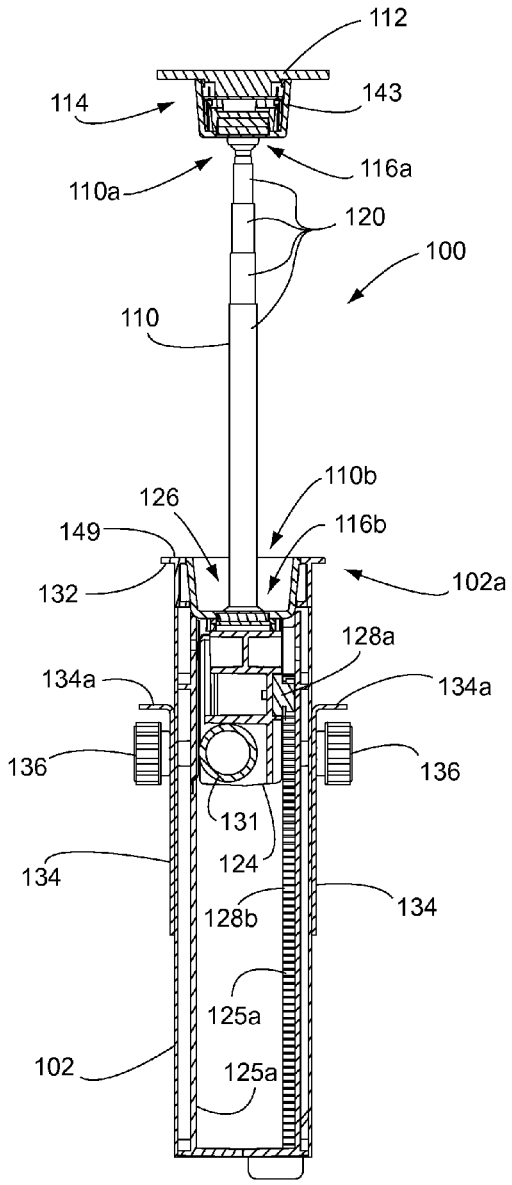
FIG. 15 is an end sectional elevation of the light assembly taken along section line XV-XV of FIG. 14.
Figure 16:
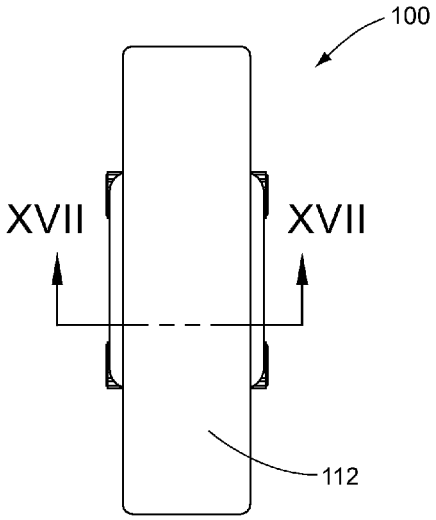
FIG. 16 is a top plan view of the retractable light assembly, similar to the view in FIG. 14, but showing the releasable work surface connectors.
Figure 18:
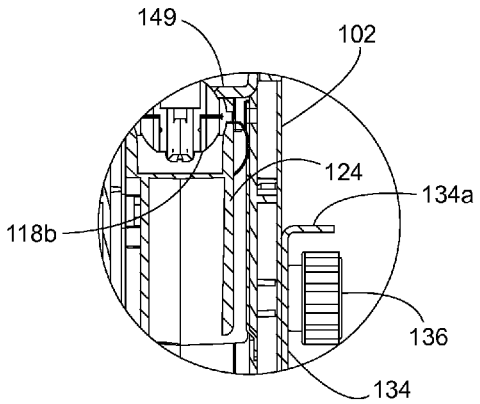
FIG. 18 is an enlarged view of the region designated XVIII in FIG. 17.
Figure 17:
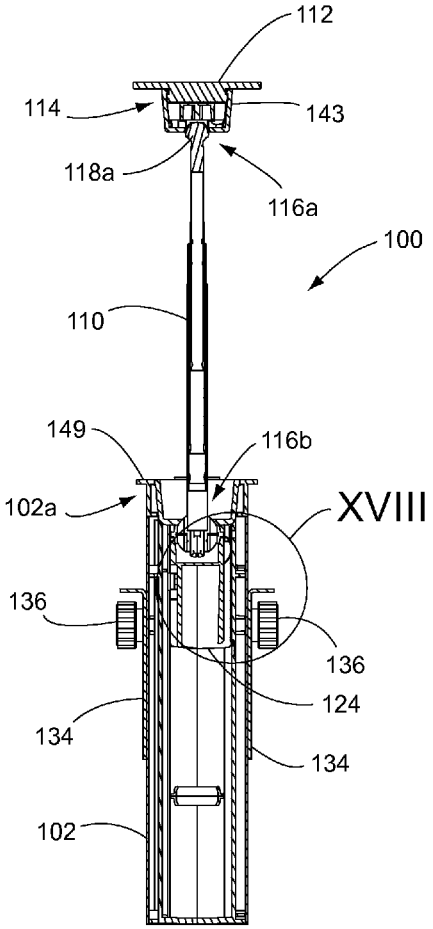
FIG. 17 is an end sectional elevation of the retractable light assembly taken along section lines XVII-XVII of FIG. 16.
Figure 19:
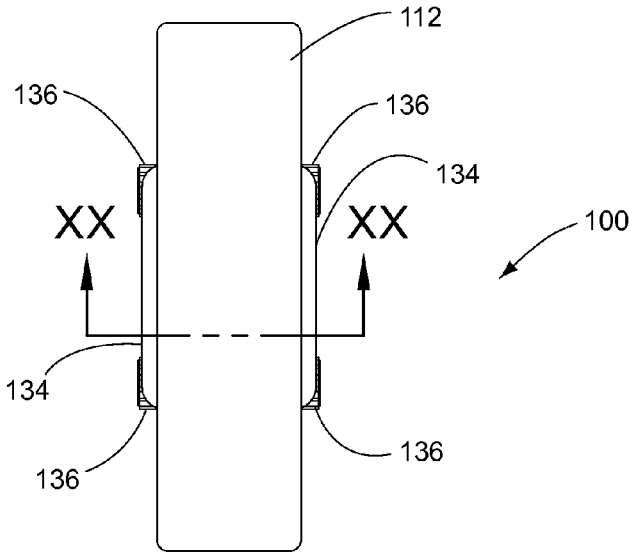
FIG. 19 is a top plan view of the retractable light assembly, similar to the view in FIG. 16, but showing the light assembly in a retracted position.
Figure 20:
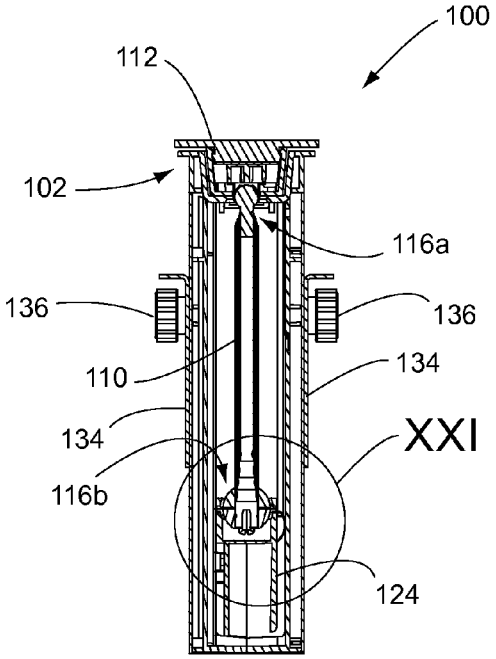
FIG. 20 is an end sectional elevation of the retractable light assembly taken along section line XX-XX of FIG. 19.

Each extendable shaft 110 has an upper end portion 110*a* coupled to lamp unit 114 via an upper gimbal joint 116*a*, and a lower end portion 110*b* coupled to lower housing 102 at a lower gimbal joint 116*b*. Extendable shafts 110 are substantially retracted into lower housing 102 when lamp assembly 108 is fully retracted, such as shown in FIGS. 9, 11, and 20, and project upwardly from lower housing 102 when the lamp assembly 108 (including lamp unit 114) is extended, such as shown in FIGS. 13, 15, and 17. Each upper end portion 110*a* of the extendable shafts 110 includes an upper ball 118*a* forming part of upper gimbal joint 116*a*, and each lower end portion 110*b* of the shafts 110 includes a lower ball 118*b* forming part of lower gimbal joint 116*b*. Upper balls 118*a* are received in upper sockets 119*a* at lamp unit 114, and lower balls 118*b* are received in lower sockets 119*b* in a carriage inside of lower housing 102 (FIG. 7), so that in the illustrated embodiment, gimbal joints 116*a*, 116*b* are configured as ball-and-socket joints. However, it will be appreciated that other forms of pivot joints may be used without departing from the spirit and scope of the present invention. It will further be appreciated that the upper or lower gimbal or pivot joint may be omitted, so that lamp assembly 108 is pivotable about joints at only the upper or lower end of the extendable shafts, which would restrict the freedom of movement of the lamp unit 114.

Figure 21:
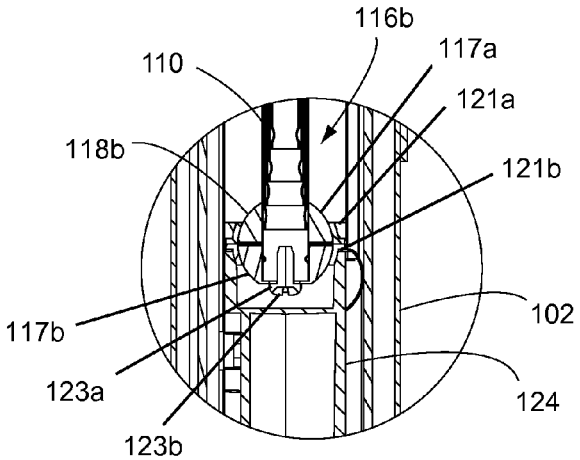
FIG. 21 is an enlarged view of the region designated XXI in FIG. 20.

In the illustrated embodiment, lower ball 118*b* is made up of an upper ball half 117*a* that is received on top of a lower ball half 117*b*, such as shown in FIG. 21. A pair of upper ball cups or covers 121*a* receive and cover the respective upper ball halves 117*a*, and a pair of lower ball cups or covers 121*b* receive and cover the respective lower ball halves 117*b*. The aforedescribed elements of the lower ball 118*b* have apertures formed or established therein, for receiving each of the telescoping poles 110. The telescoping poles 110 are then rotatably secured within the lower ball 118*b* via washers 123*a* and screws 123*b*. With this assembly, the electric lamp unit 114 can then be secured to the lower housing 102. The electric lamp unit 114 has a lens portion 143 with a pair of apertures 143*a* (FIG. 13) through which the upper balls 118*a* are received for engagement with upper sockets 119*a*.

Figure 29:
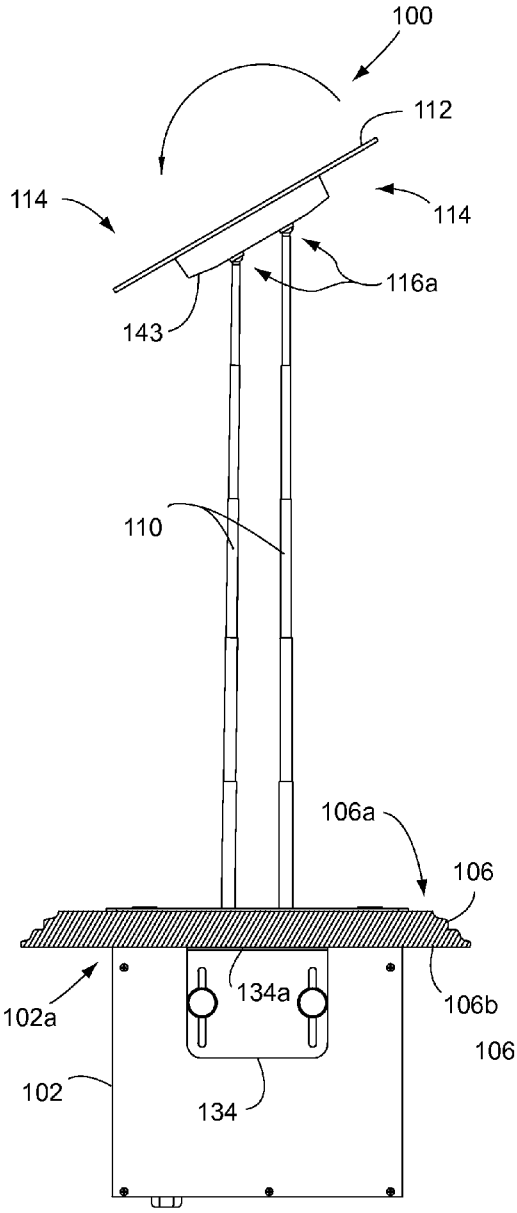
FIG. 29 is a side elevation of the retractable light assembly of FIG. 1, shown with the upper light assembly of the electric lamp portion in a fully-extended position and rotated to the rear.
Figure 30:
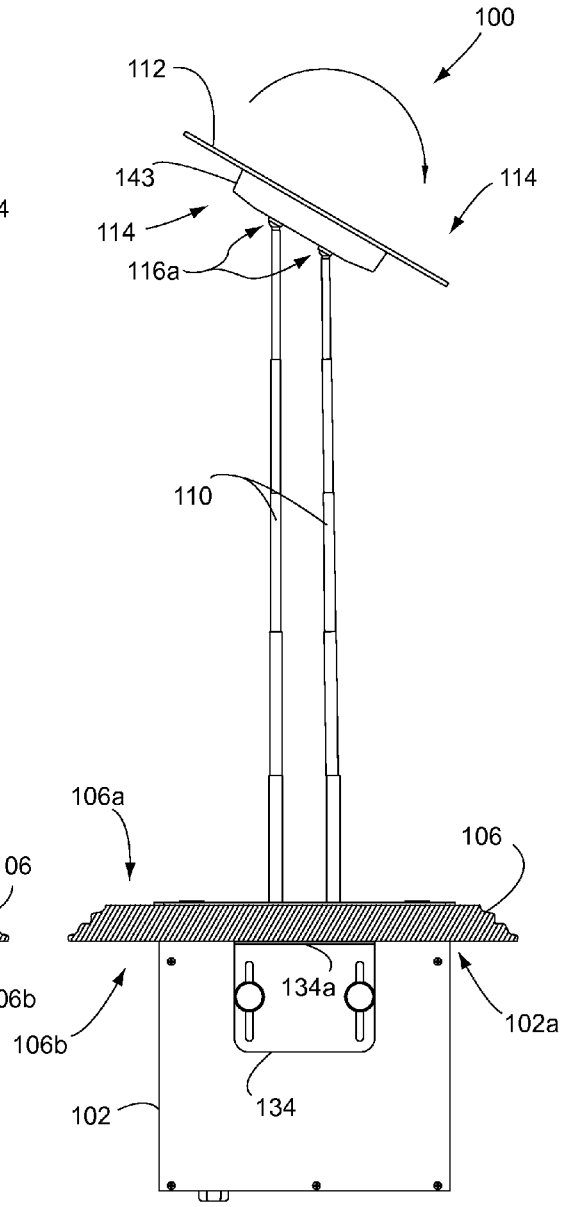
FIG. 30 is another side elevation and sectional elevation similar to FIG. 29, shown with the upper light assembly rotated to the front.

The lamp assembly 108 with the electric lamp unit 114 may be extended upwardly and then repositioned or re-oriented or rotated as desired through the manual or automated (e.g., power servo-actuated) manipulation of the extension of the extendable shafts 110 and gimbal joints 116*a*, 116*b*. Shafts 110 and gimbal joints 116*a*, 116*b* permit a wide range of movement and orientations of lamp unit 114 relative to lower housing, such as shown in FIGS. 25-32. In the illustrated embodiment, extendable shafts 110 are each made up of a plurality of frictionally-engaged telescoping sections 120, each of which is longitudinally extendable and retractable relative to an adjacent section (FIG. 13). This permits the extension height of electric lamp unit 114 to be adjusted from a fully closed position (FIGS. 1 and 3) to a plurality of relatively low heights, as in FIGS. 2, 5, and 23, to a plurality of relatively high heights, as in FIGS. 6, 6A, 25, and 28. Moreover, extendable shafts 110 may be extended to different lengths, such as shown in FIGS. 29 and 30, to permit angling of lamp unit 114 relative to work surface 106. Extendable shafts 110 are substantially strong and rigid, and may be similar in this respect to retractable telescoping automobile antennas, for example.

Thus, gimbal joints 116*a*, 116*b* and extendable shafts 110 cooperate to permit lamp unit 114 to pivot and/or rotate about different axes or points when lamp assembly 108 is in one of its raised positions, so that light emanating from the lamp unit 114 can be directed to a desired area of the work surface 106. This allows a user to manually manipulate lamp unit 114 as desired to illuminate different portions of the work surface 106, such as shown diagrammatically in FIGS. 25-28.

Figures 26, 27, 28:
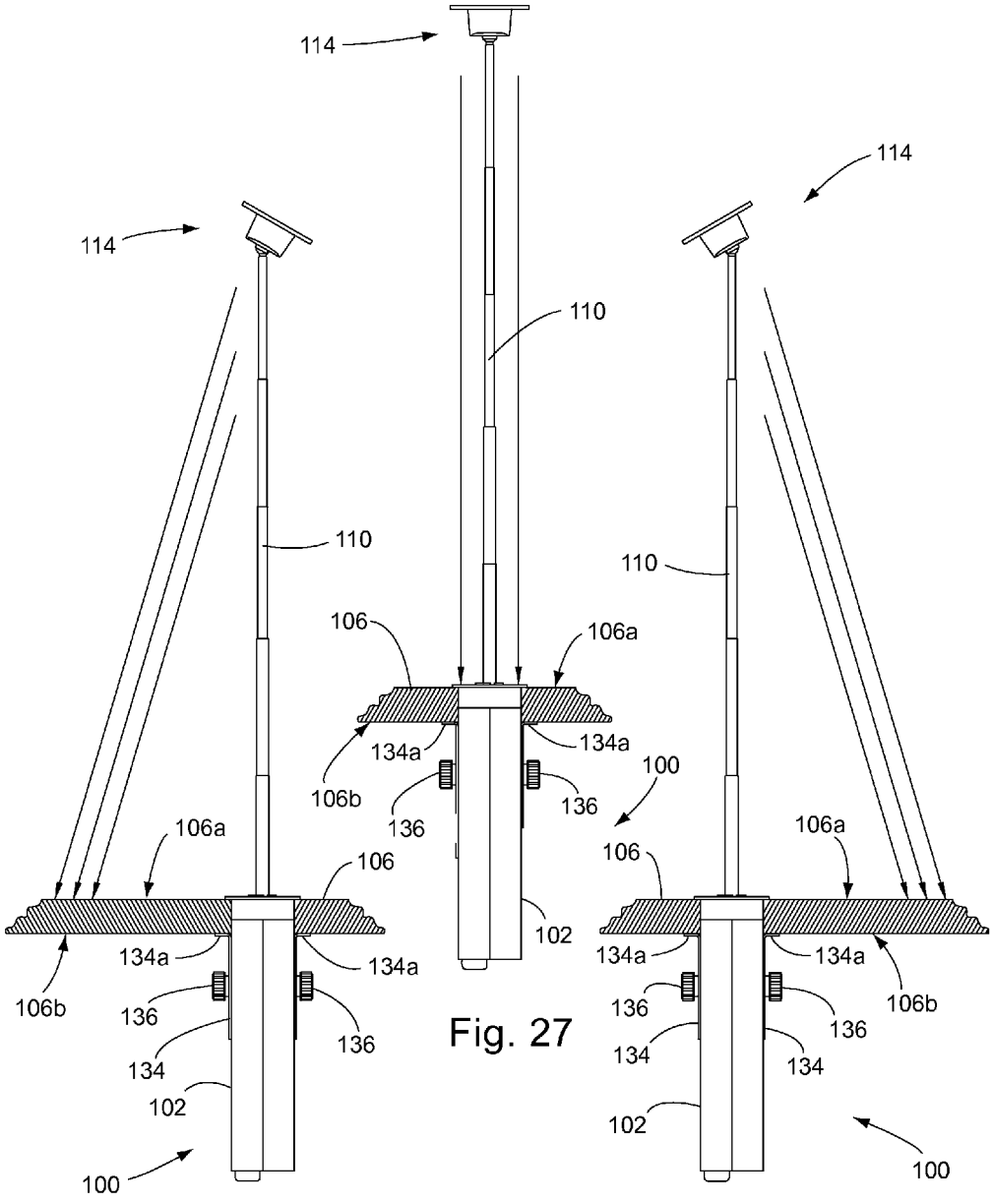
FIG. 26 is an end elevation of the retractable light assembly of FIG. 1, shown with the upper light assembly of the electric lamp portion in a fully-extended position and rotated to the right, and showing the relative direction of light rays emanating to the left.
FIG. 27 is another end elevation of the retractable light assembly, similar to the view of FIG. 26, but shown with the upper light assembly of the electric lamp portion in a non-rotated position, and showing the relative direction of light rays emanating generally straight downwardly.
FIG. 28 is another end elevation of the retractable light assembly, similar to the view of FIG. 26, but shown with the upper light assembly rotated to the left, and showing the relative direction of light rays emanating to the right.
Figure 31:
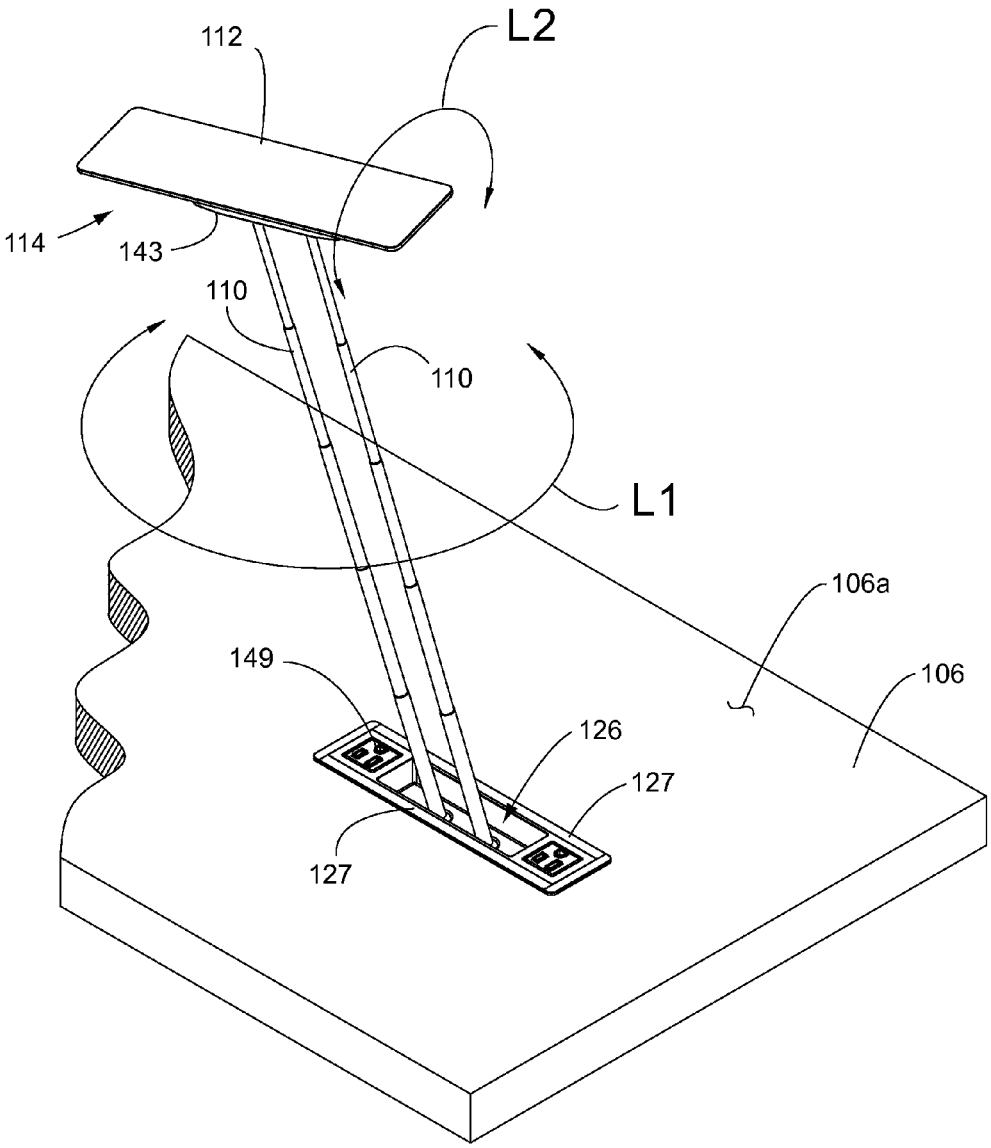
FIG. 31 is a perspective view of the retractable light assembly in a fully-extended position, and received within the work surface, and further showing (by arrows) some of the possible movements of the electric lamp portion.
Figure 32:
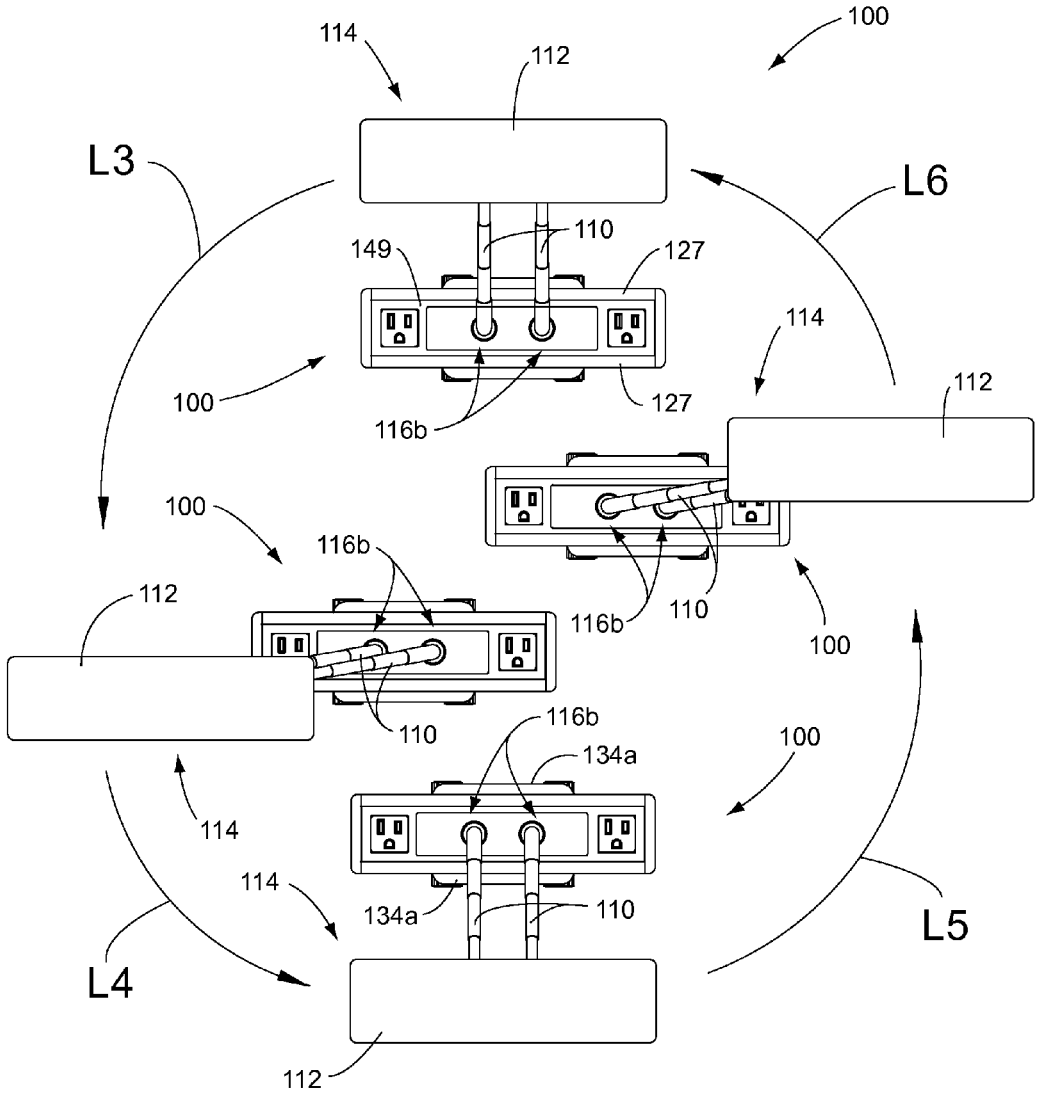
FIG. 32 is a top plan and partially-diagrammatic view showing the retractable light assembly in four positions achieved by tilting the telescoping poles of the electric lamp portion.

Referring to FIGS. 25-32, the lamp unit 114 may be rotated or pivoted to various positions relative to the vertical. For example, the lamp unit 114 may be pivoted through angles of at least about 30 degrees relative to substantially any horizontal axis (FIGS. 26-32), and may be leveled in a substantially horizontal plane (FIG. 27). The pivoting motions of lamp unit 114 may be accomplished through upper and lower gimble joints 116*a*, 116*b* and the extension or retraction of the extendable shafts 110. FIGS. 31 and 32 are further illustrative of the manner in which the gimble joints 116*a*, 116*b* and shafts 110 cooperate to allow the lamp unit 114 to also be rotated or skewed or twisted relative to the respective longitudinal axes of the shafts 110, such as indicated by curved lines L1 and L2 of FIG. 31, and by curved lines L3-L6 in FIG. 32. In FIG. 32, light assembly 100 is shown in four plan views in which the extendable shafts 110 are rotated away from a vertical axis through their respective lower gimble joints 116*b*. For example, the right-most view of FIG. 32 generally corresponds to the position of extendable shaft 110 as shown in FIG. 31, in which the shafts are skewed from vertical.

Cover member 112 is positioned atop the lamp unit 114, and is configured to reflect light from one or more bulbs or lamps 122 (FIG. 6A) in the direction of the work surface 106. The cover member substantially covers an upper end portion 102*a* of the lower housing 102 (including faceplate 149) when the lamp assembly 108 is at its fully lowered position, such as shown in FIGS. 1, 3, 9, 11, 20, and 33-35. In addition, the cover member 112 may be generally unobtrusive when the lamp is at the fully lowered position, such as slightly above or substantially flush with an upper surface portion 106*a* of the work surface 106 (FIGS. 33-35), with a substantial portion of the lamp assembly 108 (including much of lamp unit 114) received in the lower housing 102 (FIGS. 9, 11, and 20).

In order to present a clean and relatively unobtrusive appearance when lamp assembly 108 is fully lowered, retractable light assembly 100 further includes a movable carriage 124 position between a pair of stationary guide track halves 125*a*, 125*b* in the lower housing 102 (FIGS. 7, 9, 11, 13, 15, 17, 18, 20, and 21). Lower gimbal joints 116*b* are partially formed by lower sockets 119*b* in carriage 124 (FIG. 7), which is movable upwardly (FIGS. 13, 15, and 17) and downwardly (FIGS. 9, 11, and 20) along the first and second guide track halves 125*a*, 125*b* in housing 102. This permits extendable shafts 110 to be stowed inside of lower housing 102 when lamp assembly 108 is fully lowered or retracted. To further permit retraction of lamp unit 114, a cavity 126 (FIGS. 2, 5-7 and 13) is formed in a faceplate 149 at the upper portion 102*a* of lower housing 102, and is sized and shaped to receive lamp unit 114 and upper gimbal joints 116*a* when lamp assembly 108 is fully lowered or retracted, such as shown in FIGS. 9 and 11. Once lamp assembly 108 is raised a sufficient distance so that lamp unit 114 disengages cavity 126, lamp unit 114 can be manipulated via pivoting movement of gimbal joints 116*a*, 116*b*.

Figure 7:
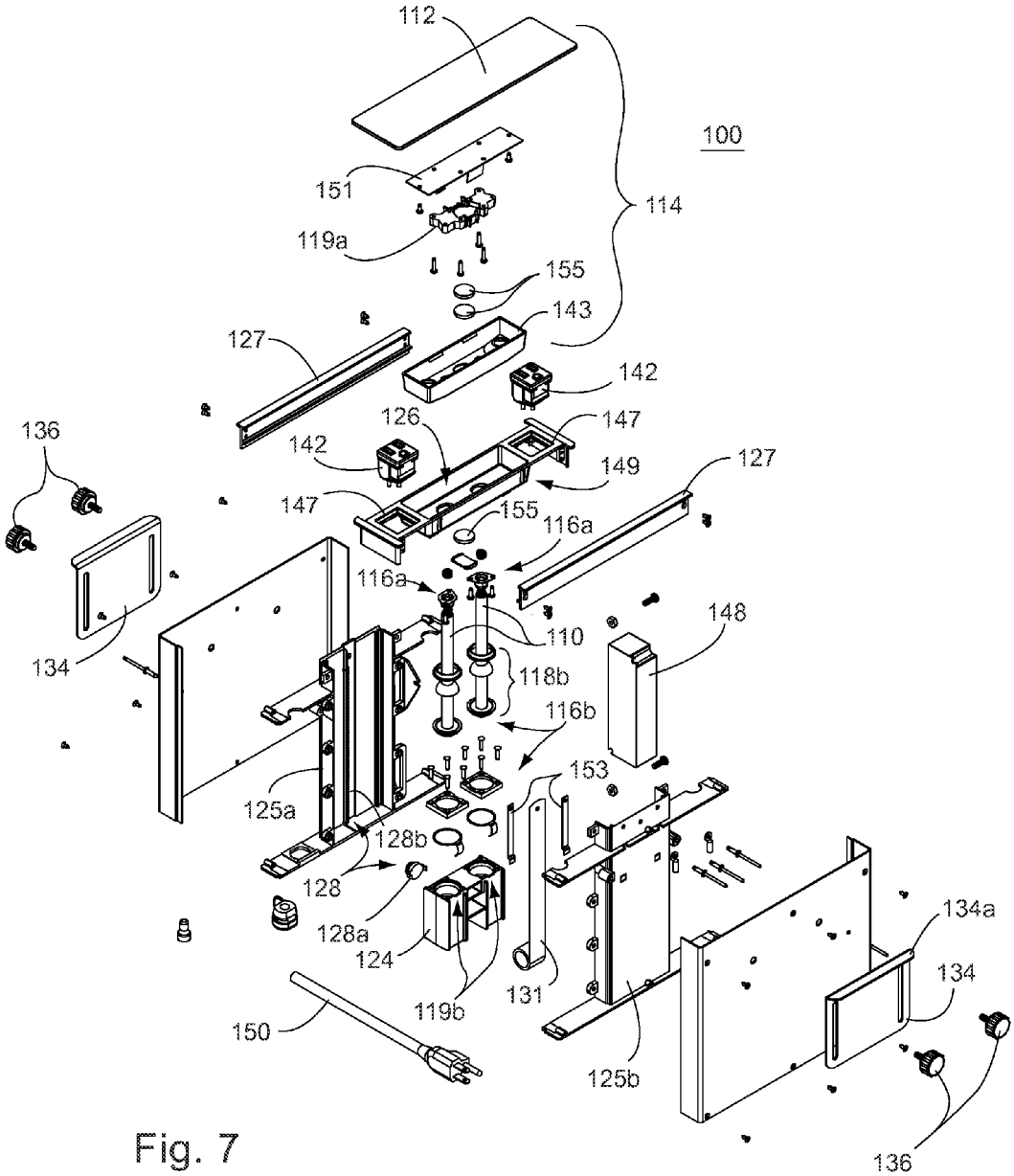
FIG. 7 is an exploded view of the retractable light assembly of FIG. 1.
Figure 8:
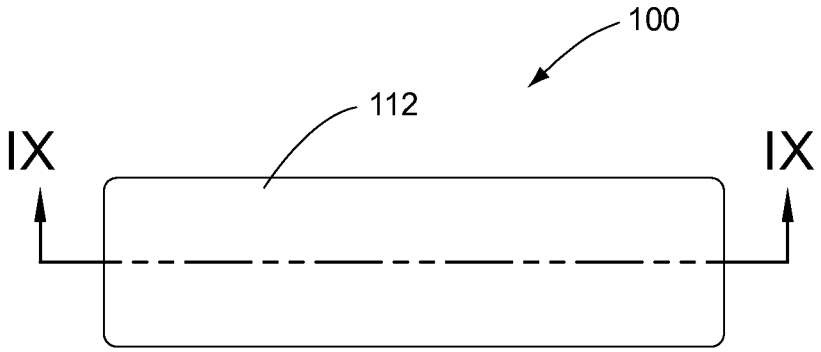
FIG. 8 is a top plan view of the light assembly of FIG. 1, shown with the light assembly in a fully retracted position and with the releasable work surface connectors omitted.

A friction element 128 includes a rotational damper 128*a* that is rotatably mounted on carriage 124 and engages a toothed rack 128*b* extending vertically along the first guide track half 125*a*, such as shown in FIGS. 7, 13, and 15. Damper 128*a* rotates as carriage 124 is moved up and down between guide track halves 125*a*, 125*b*, and its frictional resistance to rotation causes the carriage 124 to remain in a substantially fixed position relative to the lower housing 102 until a user applies a sufficiently large vertical (upward or downward) force to overcome the friction in rotational damper 128*a*. In the illustrated embodiment, rotational damper 128*a* acts as a pinion that traverses or rolls along the toothed rack 128*b* as the carriage moves up and down. However, it will be appreciated that other types of frictional mechanisms or arrangements, or powered raising and lowering mechanisms, may be used without departing from the spirit and scope of the present invention. In addition, a flat spiral spring 131 is coupled at its upper end to the second guide track half 125*b*, while its lower (spiral) end is received in a recess formed in carriage 124, such as shown in FIG. 7. Spring 131 aids users in raising carriage 124 and lamp assembly 108 by counteracting the weight of these latter components.

Figure 6:
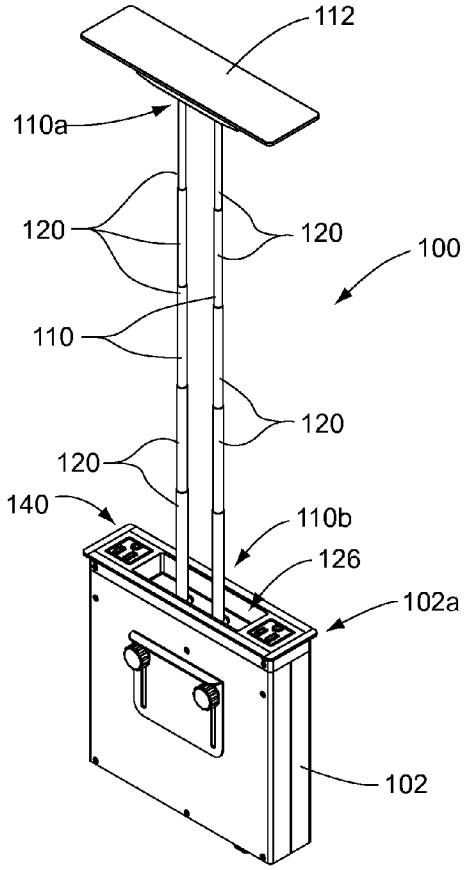
FIG. 6 is another perspective view of the light assembly of FIG. 3, shown with the electric lamp portion fully extended and not illuminated.
Figure 6A:
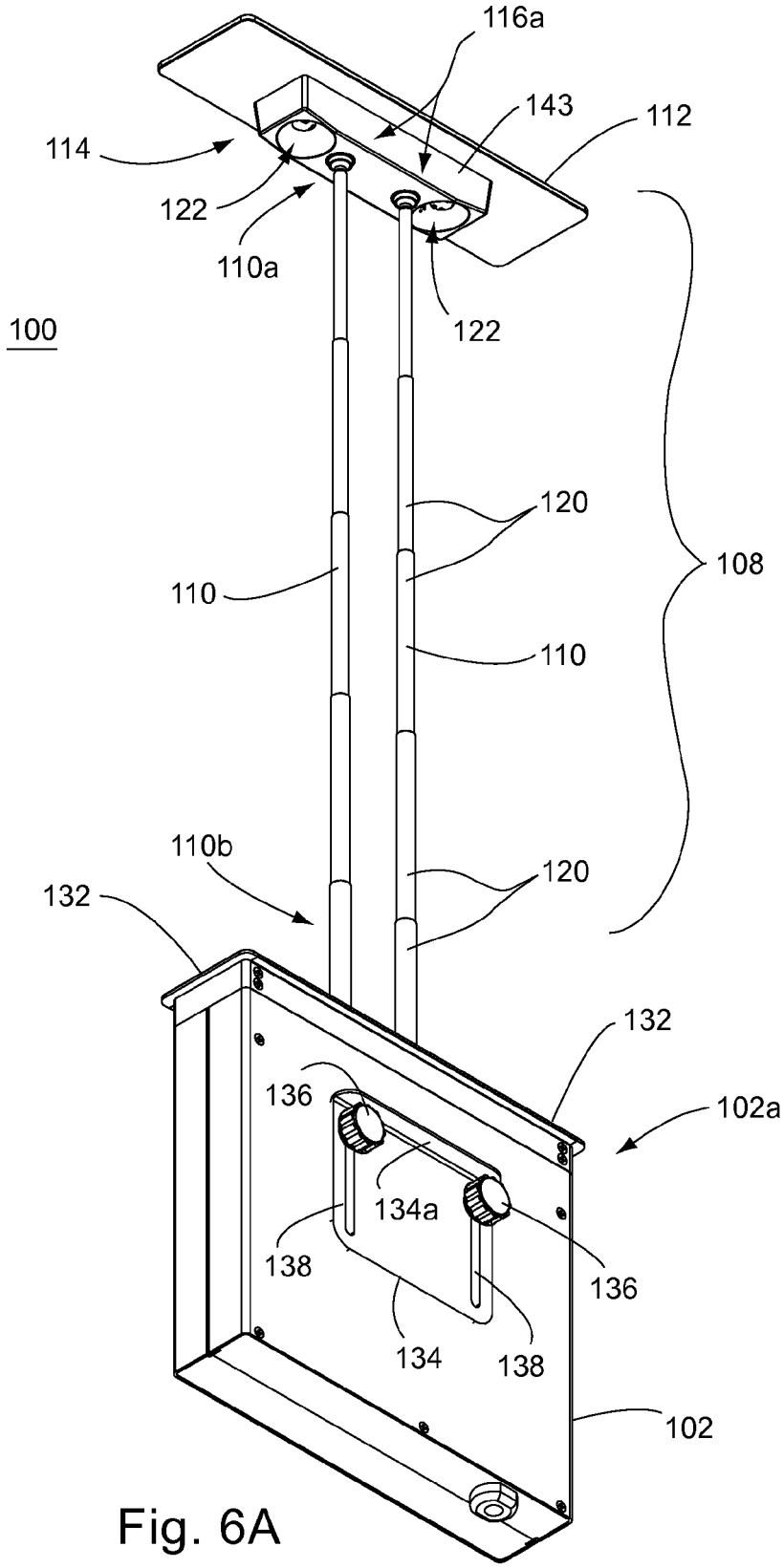
FIG. 6A is a bottom perspective view of the light assembly of FIG. 6.
Figure 22:
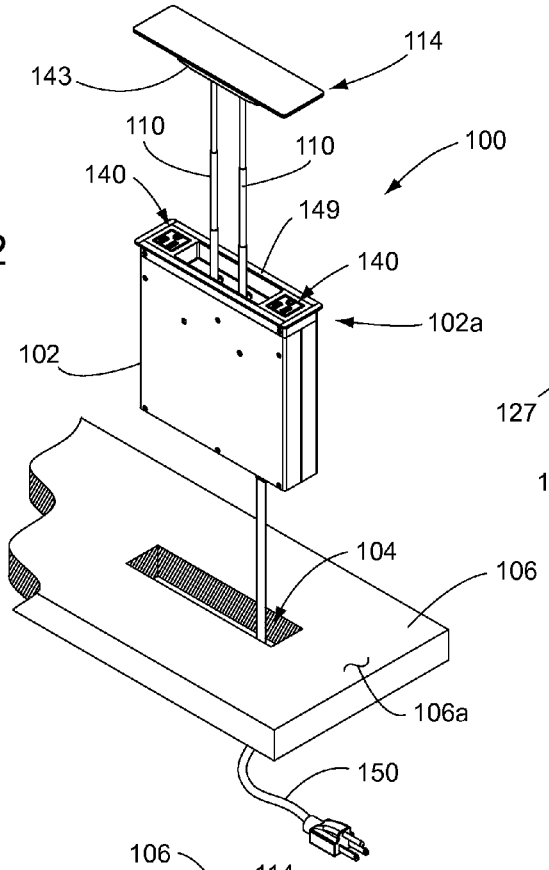
FIG. 22 is a perspective view of the retractable light assembly of FIG. 2, shown positioned above an opening in a work surface.
Figure 24:
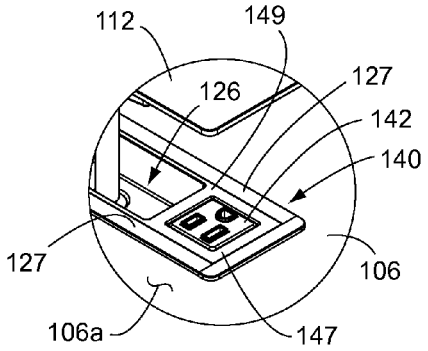
FIG. 24 is an enlarged view of the region designated XXIV in FIG. 23.
Figure 23:
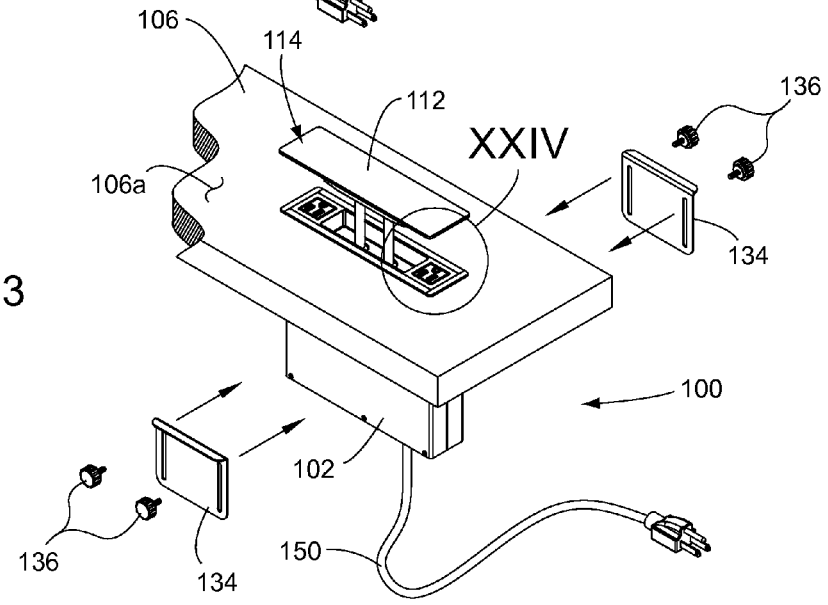
FIG. 23 is another perspective view of the retractable light assembly of FIG. 22, shown with the lower housing positioned in the opening in the work surface.
Figure 25:
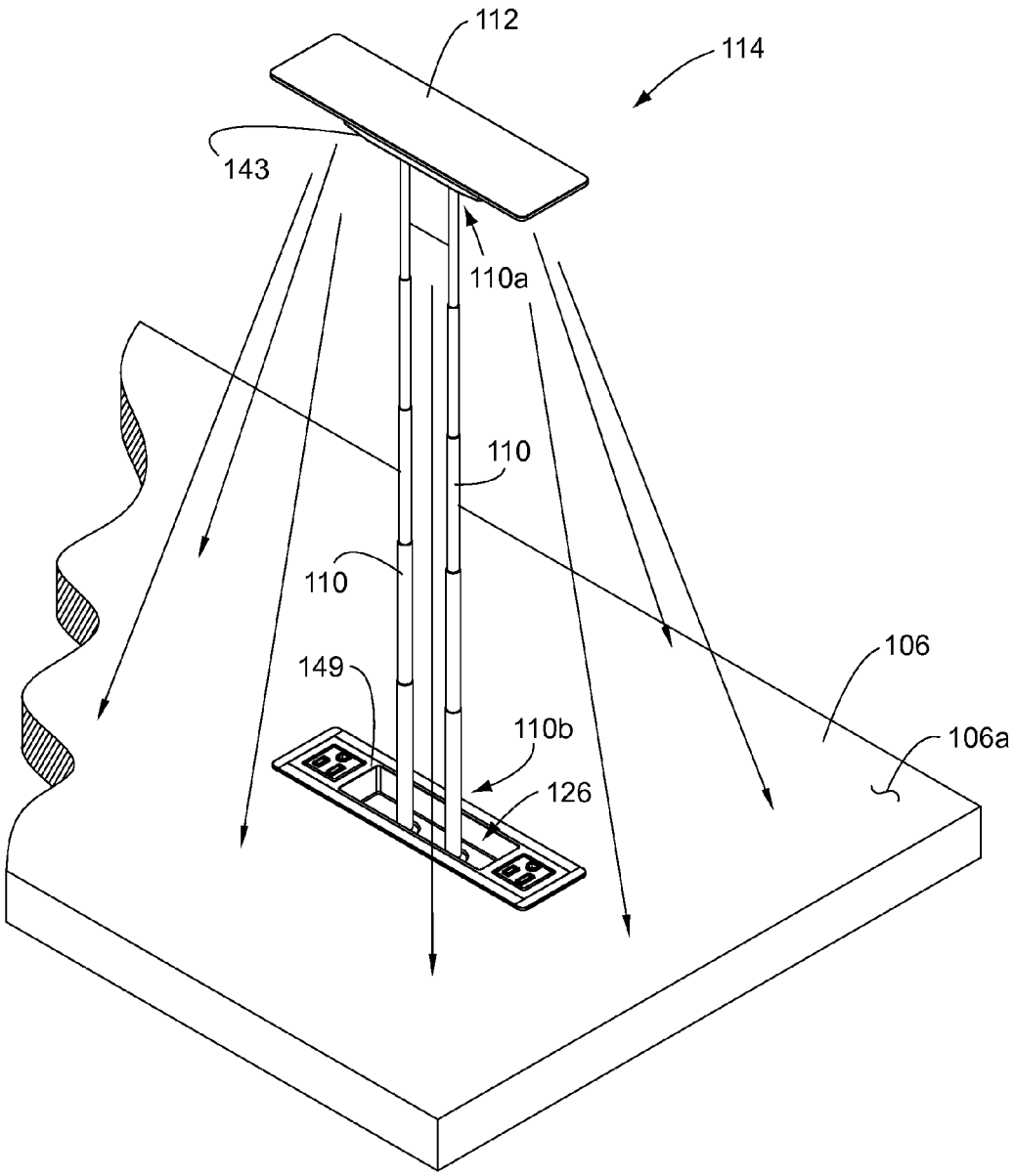
FIG. 25 is a perspective view of the retractable light assembly of FIG. 23, shown with the electric lamp portion in a fully-extended position, and further showing the general direction of light rays emanating from the lamp portion as they impinge on the work surface.
Figure 33:
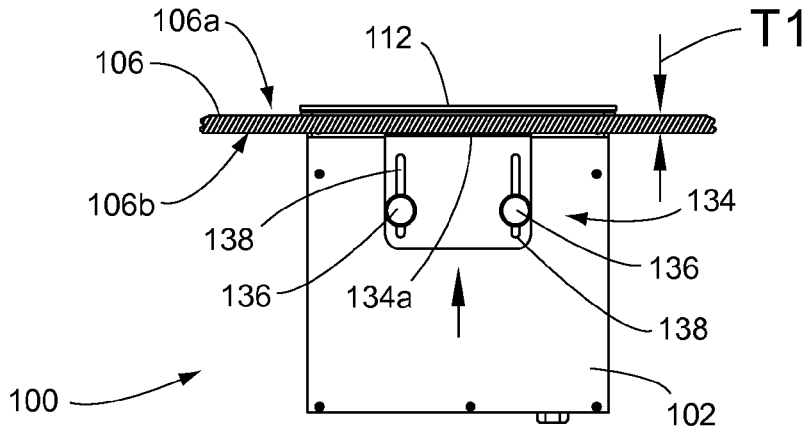
FIG. 33 is a side elevation of the retractable light assembly shown positioned at a relatively thin work surface.
Figure 34:
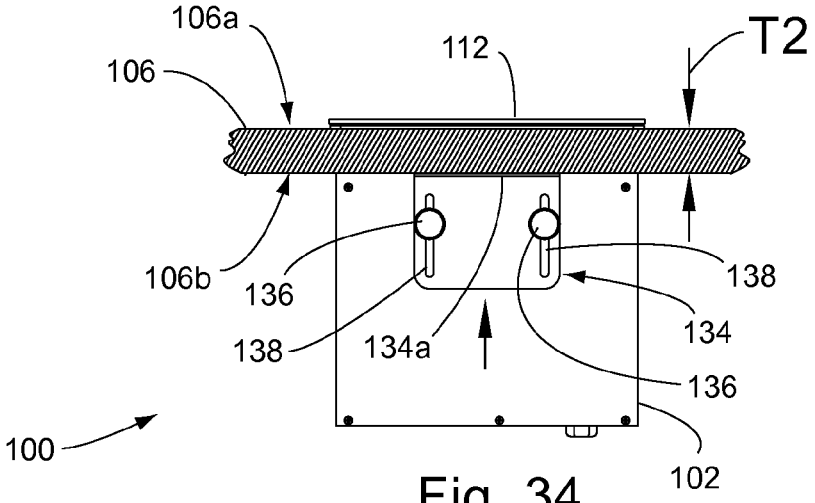
FIG. 34 is another side elevation of the retractable light assembly shown positioned at a work surface having moderate thickness.
Figure 35:
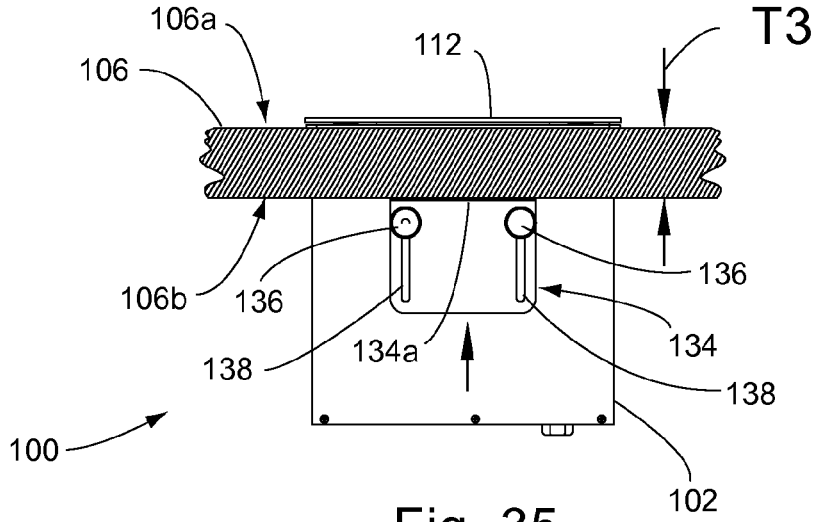
FIG. 35 is a side elevation of the retractable light assembly shown positioned at a relatively thick work surface.
Figure 36:
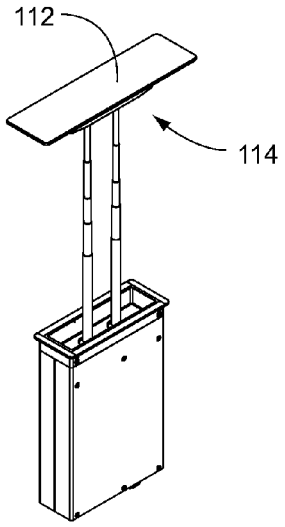
FIG. 36 is a perspective view of another retractable light assembly in accordance with the present invention, which lacks power receptacle assemblies.
Figure 37:
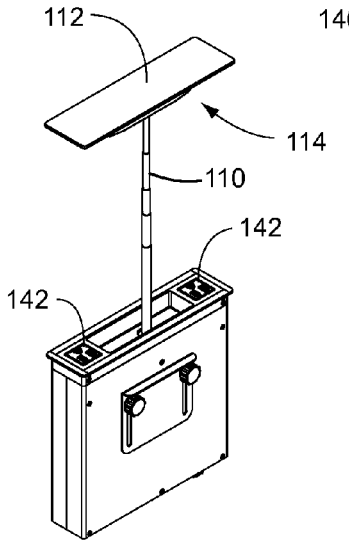
FIG. 37 is a perspective view of another retractable light assembly in accordance with the present invention, including an electric lamp portion having a single telescoping shaft.

An upper flange 132 is formed in part by opposite ends of faceplate 149 and by a pair of longitudinal flanges 127 located at the housing upper end portion 102*a*, such as shown in FIGS. 6A, 7, and 23. Upper flange 132 extends outwardly from lower housing 102 in order to engage upper surface portion 106*a* of work surface 106 when lower housing is lowered into aperture 104 formed in work surface 106. Thus, the weight of retractable light assembly 100 is substantially supported by the perimeter region of work surface 106 that defines aperture 104 (FIGS. 22-23). An adjustable bracket 134 is provided on either side of lower housing 102 for securing light assembly 100 to work surfaces 106 having different thicknesses T1, T2, T3, such as shown in FIGS. 33-35. Each adjustable bracket 134 is coupled to lower housing 102 via a pair of thumbscrews 136, which include threaded portions that are disposed through respective vertical slots 138 in the bracket 134 and into threaded bores in lower housing 102. Slots 138 permit each bracket 134 to be vertically adjusted relative to lower housing 102, with each bracket 134 at a relatively low position when work surface 106 has a relatively large thickness T3 (FIG. 35), at a relatively high position when work surface 106 has a relatively small thickness T1 (FIG. 33), and at a medium position when work surface 106 has a medium thickness T2 (FIG. 34). Each bracket 134 includes a bracket flange 134*a* (FIGS. 7 and 11) that is moved into engagement with a lower surface portion 106*b* of work surface 106 when lamp assembly 100 is to be secured to the work surface. Once upper surface portion 106*a* is engaged by upper flange 132 and lower surface portion 106*b* is engaged by bracket flange 134*a*, thumbscrews 136 may be tightened to secure bracket 134 relative to lower housing 102, which secures the housing at work surface 106, such as shown in FIGS. 33-35.

Figure 3:
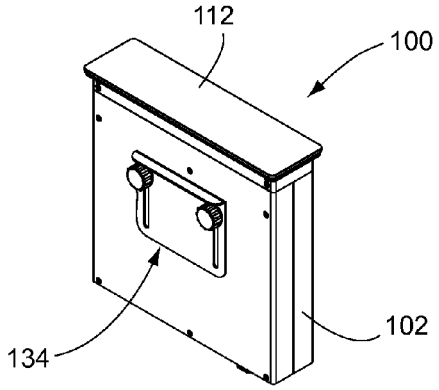
FIG. 3 is another perspective view of the light assembly of FIG. 1, shown with the power cord omitted.
Figure 38:
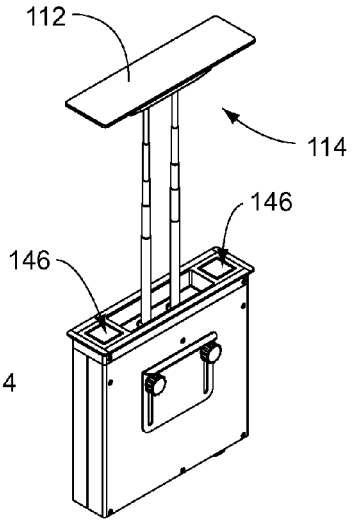
FIG. 38 is a perspective view of another retractable light assembly in accordance with the present invention, including openings for receiving wiring or electrical outlets.
Figure 39:
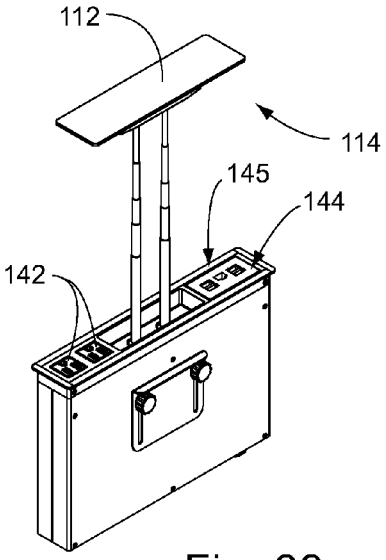
FIG. 39 is a perspective view of another retractable light assembly in accordance with the present invention, including a pair of power receptacle assemblies on one side of the lower housing and several energy center connectors on an opposing side of the lower housing.
Figure 40:
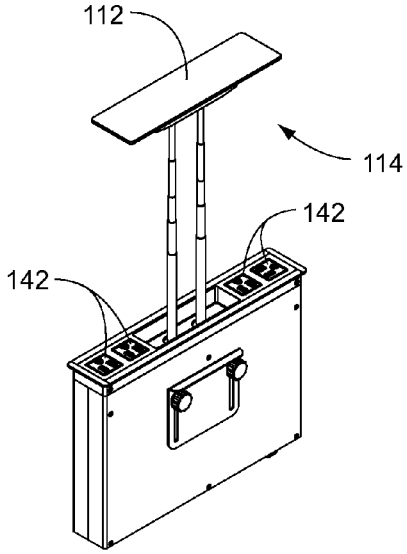
FIG. 40 is a perspective view of another retractable light assembly in accordance with the present invention, including a pair of power receptacle assemblies on one side of the lower housing.
Figure 41:
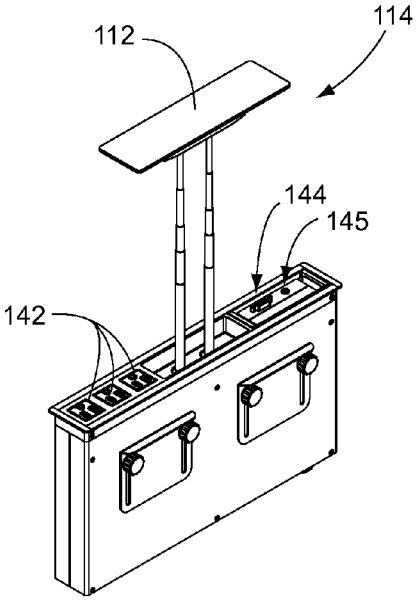
FIG. 41 is a perspective view of another retractable light assembly in accordance with the present invention, including three power receptacle assemblies on one side of the lower housing and different electrical connectors on the opposing side of the lower housing.
Figure 42:
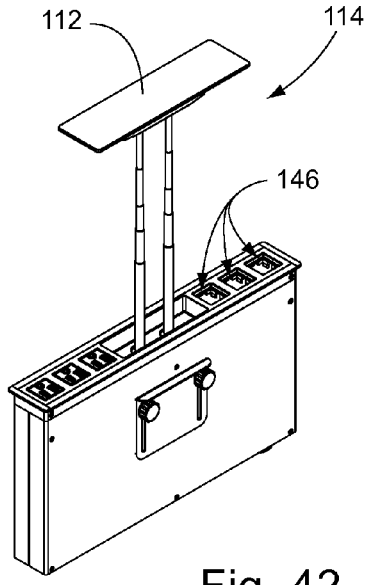
FIG. 42 is a perspective view of another retractable light assembly in accordance with the present invention, including three power receptacle assemblies on one side of the lower housing and three data ports on the opposing side of the lower housing.
Figure 43:
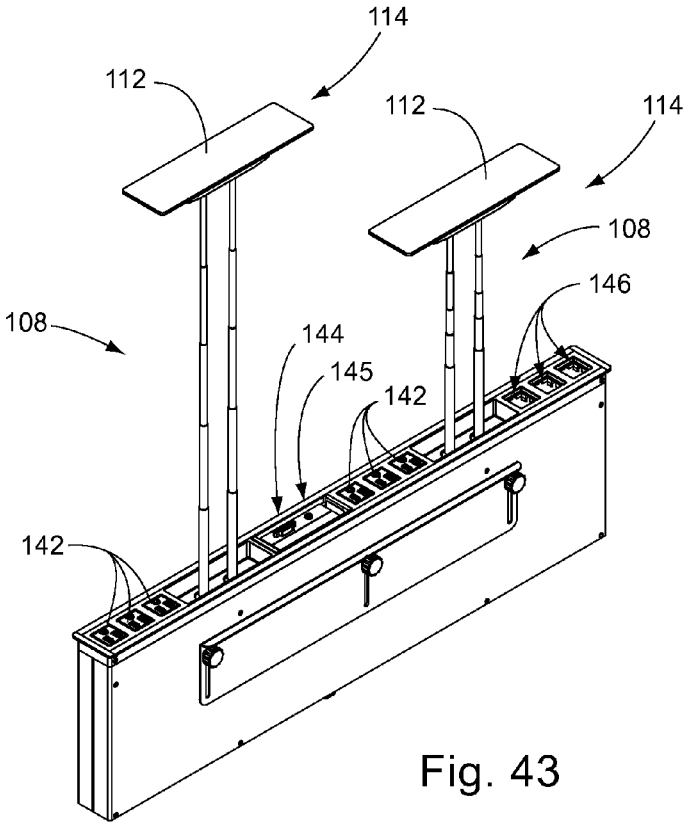
FIG. 43 is a perspective view of another retractable light assembly in accordance with the present invention, including a pair of electric lamp portions, two sets of electrical receptacle assemblies, an energy center, and a set of data ports.

Optionally, the retractable light assembly 100 may include one or more electrical power outlets 140 at the upper end portion 102 of the lower housing 102. Electrical power outlets 140 may be standard 110 VAC or 220 VAC power outlets 142, such as shown in FIGS. 2, 5-7, and 22-24, or may be low-voltage charger outlets 144 or data ports 145 (FIGS. 39 and 41). Optionally, passageways 146 (FIGS. 38, 42, and 43) may be provided for routing wires (such as power or data cables or the like) into lower housing 102 from above work surface 106. Passageways 146 are defined by open bezels 147 formed in faceplate 149 (FIG. 7), which may further be configured for optionally supporting power outlets 142 and/or charging, data, and low voltage outlets. Such bezels and outlets and passageways are described in more detail in commonly-owned U.S. Pat. Nos. 7,182,633 and 8,287,292, and in U.S. patent application Ser. No. 12/816,051 (U.S. Publication No. 2010/0317223) filed Jun. 15, 2010, and U.S. patent application Ser. No. 13/180,137 (U.S. Publication No. 2012/0009820) filed Jul. 11, 2011, all of which are hereby incorporated herein by reference in their entireties. It will be appreciated that cover member 112 may be sized and shaped to substantially cover the electrical outlets 140 or passageways 146 when the lamp assembly 108 is fully lowered, such as shown in FIGS. 1, 3, and 9, or the cover member may cover less than all of the outlets or passageways, such as shown in FIGS. 39-43.

In the illustrated embodiment, lamp unit 114 includes electric bulbs or lamps 122, which may be incandescent lamps, fluorescent lamps, LED lamps, or the like. Lamps 122 may be any sufficiently bright lamps, particularly electrical lamps. In the illustrated embodiment, and as shown in FIG. 7, lamps 122 are LED lamps mounted in a circuit board 151 that includes an electrical switch, and are mounted behind (above) a lens 143. Lamps 122 are powered by an AC power source that is accessed via a power cord 150 (FIGS. 1, 2, 7, 22, and 23), through an LED driver 148, with wiring routed through the lower housing, a pair of electrical contacts 153, and one or more of the extendable shafts 110. Power cord 150 may also be used to power the outlets 140 at the upper end portion 102*a* of lower housing 102. Optionally, the lamp unit may be configured to receive one or more electrical batteries for powering the lamps, which may be particularly suitable for lower-cost or portable light assemblies, particularly when the lamps exhibit low power consumption (e.g., LED lamps), or for light assemblies that are infrequently used or located in areas where electrical service is not readily available.

Figure 4:
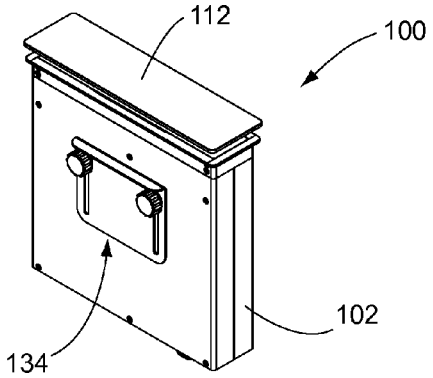
FIG. 4 is another perspective view of the light assembly of FIG. 3, shown with the electric lamp portion slightly extended after it has been released from the lower housing.
Figure 5:
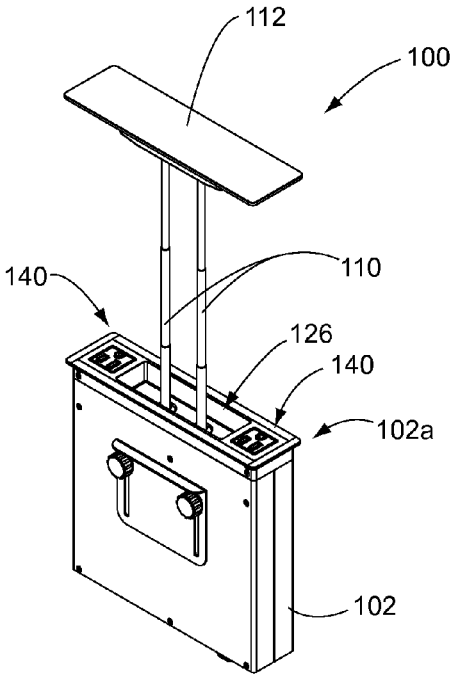
FIG. 5 is another perspective view of the light assembly of FIG. 3, shown with the electric lamp portion partially extended and not illuminated.

Optionally, a switch provided at circuit board 151 automatically energizes lamp unit 114 when the lamp unit is raised above its fully-lowered position, such as by a user pushing downwardly on cover member 112 to initially release lamp unit 114 (e.g., via a spring-latch arrangement), such as shown in FIG. 4. It is envisioned that a proximity switch, such as a magnetically-actuated or mechanically-actuated switch that detects when lamp unit 114 is fully lowered, could be used, for example. Otherwise, a separate switch may be provided so that the user may turn the lamp on or off as desired when the lamp unit 114 is raised. Optionally, magnets 155 may be provided in lens 143 and below faceplate 149 (FIG. 7), so that their magnetic interaction (when lens 143 is received in cavity 126 of faceplate 149) will releasably retain lamp unit 114 in the fully-lowered position until it is manually released by a user.

Optionally, and with reference to FIGS. 36-43, various different configurations of retractable lamp assembly are shown, each having a different configuration of extendable electric lamp assembly and/or a different configuration of power outlets, data ports, or passageways. For example, in FIG. 36 a retractable lamp assembly lacks any power outlets, data ports, or passageways; in FIG. 37, a retractable lamp assembly has a single extendable shaft 110 and only one power outlet 142 on either side; in FIG. 38, a retractable lamp assembly lacks power or data outlets, but includes a wire passageway 146 on either side; in FIG. 39, a retractable lamp assembly includes a pair of power outlets 142 on one side with low-voltage charger outlets 144 and a data port 145 on the other side; in FIG. 40, a retractable lamp assembly includes a pair of power outlets 142 on each side; in FIG. 41, a retractable lamp assembly includes three power outlets 142 on one side and a charger outlet 144 and data port 145 on the other side, with two mounting brackets per side; in FIG. 42 a retractable lamp assembly includes three power outlets 142 on one side and three passageways 146 on the other side; and in FIG. 43, a retractable lamp assembly includes a pair of electric lamp assemblies with three power outlets 142 at one end, a charger outlet 144 and data port 145 and three more power outlets 142 in a middle region, three passageways 146 at the other end, and with an extended-length mounting bracket on each side. Accordingly, it will be appreciated that many different configurations or variations are envisioned for providing various lighting, power, and data capabilities at a work surface by way of a single retractable lighting assembly.

Therefore, the present invention provides retractable a lamp for illumination at least a portion of a work surface from a wide range of desired heights and angles. The lamp may be stowed in a retracted or lowered configuration, in which a substantial portion of the extendable structure is stowed inside of a housing located substantially below the work surface, so that the stowed lamp is generally unobtrusive. When the lamp is stowed, an upper cover is positioned close to the work surface, or may be substantially flush with the work surface. The lamp assembly may further include power and data and wire management capabilities for use at the work surface.

Changes and modifications in the specifically described embodiments can be carried out without departing from the principles of the present invention, which is intended to be limited only by the scope of the appended claims, as interpreted according to the principles of patent law including the doctrine of equivalents.

The embodiments of the invention in which an exclusive property or privilege, is claimed are defined as follows:

1. A retractable light assembly for illuminating a work surface, said light assembly comprising:

a lower housing configured to be positioned at or in a work surface;

a lamp that is repositionable between at least a raised position spaced above said lower housing, and a lowered position at said lower housing, wherein said lamp is operative to illuminate at least a portion of the work surface when in said raised position;

at least one extendable shaft having a lower end portion coupled to said lower housing, and an upper end portion coupled to said lamp;

a first gimbal joint at said lower end portion of said extendable shaft for coupling said extendable shaft to said lower housing;

a second gimbal joint for coupling said extendable shaft to said lamp, wherein said lamp is independently pivotable about said first and second gimbal joints for illuminating a desired portion of the work surface; and wherein said lamp is pivotable about said first gimbal joint when said lamp is in said raised position.

2. A retractable light assembly for illuminating a work surface, said light assembly comprising:

a lower housing configured to be positioned at or in a work surface;

a lamp that is repositionable between at least a raised position spaced above said lower housing, and a lowered position at said lower housing, wherein said lamp is operative to illuminate at least a portion of the work surface when in said raised position;

a cover member positioned atop said lamp, said cover member configured to reflect light from said lamp in the direction of the work surface, wherein said cover member substantially covers an upper end portion of said lower housing when said lamp is at a fully lowered position;

at least one extendable shaft having a lower end portion coupled to said lower housing, and an upper end portion coupled to said lamp;

a gimbal joint at one of said lower end portion of said extendable shaft for coupling said extendable shaft to said lower housing, or said upper end portion of said extendable shaft for coupling said extendable shaft to said lamp; and wherein said lamp is pivotable about said gimbal joint when said lamp is in said raised position.

3. The light assembly of claim 1, wherein said lamp is rotatable about a longitudinal axis of said extendable shaft.

4. The light assembly of claim 3, comprising at least two of said extendable shafts having respective lower end portions, upper end portions, and wherein said first and second gimbal joints are coupled to said lower end portions and said upper end portions, respectively.

5. The light assembly of claim 1, wherein said extendable shaft comprises a plurality of telescoping shaft portions that are extendable and retractable relative to one another.

6. The light assembly of claim 1, further comprising a cover member positioned atop said lamp, said cover member configured to reflect light from said lamp in the direction of the work surface.

7. The light assembly of claim 2, wherein said gimbal joint comprises a first gimbal joint for coupling said extendable shaft to said lower housing, and wherein said light assembly further comprises a second gimbal joint for coupling said extendable shaft to said lamp, whereby said lamp is independently pivotable about said first and second gimbal joints for illuminating a desired portion of the work surface.

8. The light assembly of claim 2, wherein said cover member is substantially flush with an upper surface portion of the work surface when said lamp is at the fully lowered position.

9. The light assembly of claim 1, wherein said extendable shaft is configured to position said lamp at a plurality of said raised positions, between a fully raised position and a fully lowered position.

10. The light assembly of claim 1, wherein at least one of said first and second gimbal joints comprises a ball joint.

11. A retractable light assembly for illuminating a work surface, said light assembly comprising:

a lower housing configured to be positioned at or in a work surface;

a lamp that is repositionable between at least a raised position spaced above said lower housing, and a lowered position at said lower housing, wherein said lamp is operative to illuminate at least a portion of the work surface when in said raised position;

at least one extendable shaft having a lower end portion coupled to said lower housing, and an upper end portion coupled to said lamp;

a gimbal joint at one of said lower end portion of said extendable shaft for coupling said extendable shaft to said lower housing, or said upper end portion of said extendable shaft for coupling said extendable shaft to said lamp;

an upper flange at an upper end portion of said lower housing;

a bracket movably coupled to an exterior side wall of said housing, wherein said bracket is securable against a lower surface portion of the work surface when said upper flange engages an upper surface portion of the work surface to thereby secure said lower housing to the work surface; and wherein said lamp is pivotable about said gimbal joint when said lamp is in said raised position.

12. The light assembly of claim 11, wherein said bracket comprises an adjustable bracket configured to engage the lower surface portion of the work surface for a range of thicknesses of the work surface.

13. The light assembly of claim 1, further comprising at least one electrical power outlet at an upper end portion of said lower housing.

14. The light assembly of claim 13, further comprising a cover member positioned atop said lamp, said cover member configured to reflect light emanating from said lamp in the direction of the work surface when said lamp is at the raised position, and wherein said cover member substantially covers said at least one electrical power outlet when said lamp is at a fully lowered position.

15. The light assembly of claim 1, wherein said lamp comprises an electric lamp, and said lower housing and said extendable shaft each comprise electrical wiring in communication with said electric lamp.

16. The light assembly of claim 1, wherein said lower housing is configured to be received in an opening formed in the work surface.

17. The light assembly of claim 1, wherein said extendable shaft is longitudinally extendable and retractable, and where said extendable shaft is positioned substantially in said lower housing when said lamp is in a fully lowered position.

18. A retractable light assembly for illuminating a work surface, said light assembly comprising:

a lower housing configured to be received in an opening formed in a work surface;

an electric lamp that is repositionable between at least a raised position spaced above said lower housing, and a lowered position, wherein said lamp is operative to illuminate at least a portion of the work surface when in said raised position;

a pair of telescopingly extendable shafts having respective lower end portions pivotably coupled to said lower housing via respective lower pivot joints, and further having respective upper end portions pivotably coupled to said electric lamp via respective upper pivot joints; and wherein said lamp is pivotable about said upper and lower pivot joints when said lamp is in said raised position.

19. The light assembly of claim 18, further comprising a substantially vertically movable carriage disposed in said lower housing, and wherein said lower pivot joints are disposed at said movable carriage and are movable with said carriage between a raised position corresponding to said raised position of said lamp, and a lowered position corresponding to said lowered position of said lamp.

20. The light assembly of claim 19, further comprising a friction element configured to resist movement of said carriage relative to said lower housing, whereby said carriage will remain in a substantially fixed position relative to said lower housing until a force sufficient to overcome said friction element is applied to said carriage.

21. The light assembly of claim 20, wherein said upper and lower pivot joints comprise ball joints.

22. The light assembly of claim 19, further comprising:

at least one electrical power outlet at an upper end portion of said lower housing;

a cover member positioned atop said lamp, said cover member configured to reflect light emanating from said lamp in the direction of the work surface when said lamp is at the raised position; and wherein said cover member substantially covers said at least one electrical power outlet when said lamp is at a fully lowered position.

* * * * *